US008427055B2

(12) United States Patent
Tsukamoto et al.

(10) Patent No.: US 8,427,055 B2
(45) Date of Patent: Apr. 23, 2013

(54) HIGH PRESSURE DISCHARGE LAMP

(75) Inventors: Takuya Tsukamoto, Hyogo (JP); Takashi Yamashita, Hyogo (JP); Hirohisa Iwabayashi, Hyogo (JP)

(73) Assignee: Ushio Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/805,772

(22) Filed: Aug. 19, 2010

(65) Prior Publication Data

US 2011/0043110 A1 Feb. 24, 2011

(30) Foreign Application Priority Data

Aug. 20, 2009 (JP) ..... 2009-190600

(51) Int. Cl.
*H01J 61/073* (2006.01)

(52) U.S. Cl.
USPC ..... 313/631; 313/331

(58) Field of Classification Search ..... 313/623–625, 313/631–633, 331–332
See application file for complete search history.

(56) References Cited

U.S. PATENT DOCUMENTS

| | | | | |
|---|---|---|---|---|
| 6,683,413 | B2 * | 1/2004 | Okubo et al. | 313/574 |
| 2007/0182331 | A1 * | 8/2007 | Haselhorst et al. | 313/631 |
| 2008/0185950 | A1 * | 8/2008 | Claus et al. | 313/267 |

FOREIGN PATENT DOCUMENTS

JP 2008-529252 A 7/2008

* cited by examiner

*Primary Examiner* — Joseph L Williams
*Assistant Examiner* — Brenitra M Lee
(74) *Attorney, Agent, or Firm* — Rader, Fishman & Grauer PLLC

(57) ABSTRACT

A high pressure discharge lamp comprises a pair of electrodes that face each other in an electric discharge container, wherein an electrode axis of each electrode is buried in a sealing portion, each electrode axis is joined to a metallic foil, two or more grooves are formed in an axis direction on a portion of the electrode axis, which corresponds to the sealing portion, an upper shoulder portion of each groove is formed in a shape of a curved surface, a diameter of the electrode axis is 0.3 mm to 1 mm, and a curvature radius of the curved surface upper shoulder portion is 5 μm-50 μm.

3 Claims, 4 Drawing Sheets

FIG. 1B
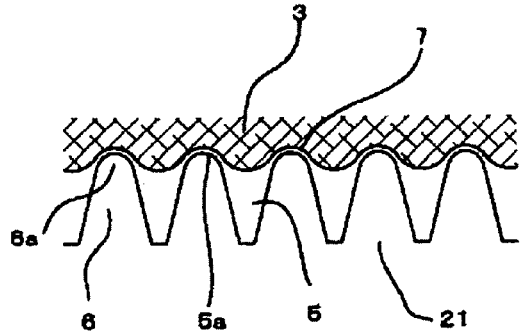
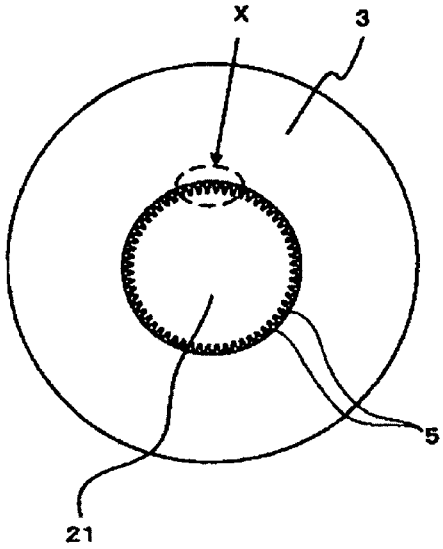
FIG. 1A
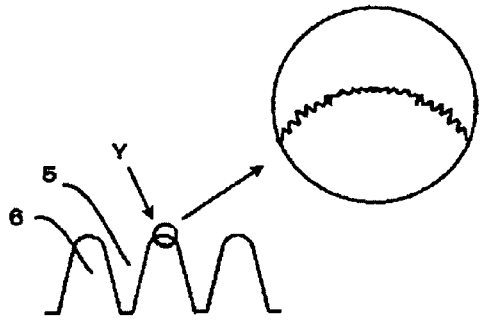
FIG. 1C

HIGH PRESSURE DISCHARGE LAMP

CROSS-REFERENCES TO RELATED APPLICATION

This application claims priority from Japanese Patent Application Serial No. 2009-190600 filed Aug. 20, 2009, the contents of which are incorporated herein by reference in its entirety.

TECHNICAL FIELD

The present invention relates to a high pressure discharge lamp, and specifically relates to a high pressure discharge lamp used as a projector apparatus or a an exposure apparatus light source.

BACKGROUND

In such a high pressure discharge lamp, the so-called foil seal structure, in which a base portion of an electrode axis is joined to a metallic foil buried in a sealing portion, is adopted as a sealing structure. In general, the electrode axis of the electrode is made of tungsten while an arc tube is made of silica glass, thus the sealing portion of the arc tube often breaks or is damages occurs due to difference in the thermal expansion coefficient in the sealing portion. This becomes a more serious problem, especially, in a high pressure discharge lamp that contains a large amount of mercury, i.e. 0.15 $mg/mm^3$ or more, enclosed in a light emitting portion since the mercury steam pressure increases, i.e. 100 or more atmospheric pressure, at time of lighting.

In order to solve such a problem, Japanese Patent Application Publication No. 2008-529252 teaches technology in which grooves are formed on an electrode axis (rode core) extending in an axial direction thereof. FIG. 3A is a schematic diagram of the structure of a lamp according to the above-mentioned example of the prior art, and FIG. 3B is an enlarged view of an electrode. As shown in FIGS. 3A and 3B, two or more grooves 5, which extend in the direction of an axis thereof, are formed on an outer surface area of an electrode axis 21 of each electrode 2 provided in a discharge lamp 1. In addition, each electrode axis 21 is connected to a metallic foil 4 in the sealing portion 3. In the above-mentioned conventional technology, the surface roughness in a circumference direction is made larger than that of a longitudinal direction thereof by forming grooves on the electrode axis, thereby preventing breakage of the sealing portion due to the difference in the thermal expansion coefficient of the materials.

SUMMARY

However, in the prior art, when the electrode axis 21 having the two or more grooves 5 that continuously extend in the electrode axis direction and that are formed by laser beam processing, is sealed, the sealing portion 3 is often damaged.

In view of the above-mentioned conventional technology, the sealing portion breakage problem that is due to a difference between the coefficient of thermal expansion of the electrode axis and that of silica glass and to a stress concentration in grooves formed in a glass side of the sealing portions is solved in the present high pressure discharge lamp by forming two or more grooves on an electrode axis in an axial direction as described.

A high pressure discharge lamp comprising a pair of electrodes that face each other in an electric discharge container, wherein an electrode axis of each electrode is buried in a sealing portion, wherein each electrode axis is joined to a metallic foil, wherein two or more grooves are formed in an axis direction on a portion of the electrode axis, which corresponds to the sealing portion, wherein an upper shoulder portion of each groove is formed in a shape of a curved surface, wherein a diameter of the electrode axis is 0.3 mm to 1 mm, and wherein a curvature radius of the curved surface upper shoulder portion is 5 μm-50 μm solves the above mention problem.

Further, the above high pressure discharge lamp may have a surface roughness of an outer surface of the grooves is 0.05 μm-1 μm.

Furthermore, the high pressure discharge lamp may have the grooves are formed by laser irradiation.

BRIEF DESCRIPTION OF THE DRAWINGS

Other features and advantages of the present high pressure discharge lamp will be apparent from the ensuing description, taken in conjunction with the accompanying drawings, in which:

FIG. 1A is a cross sectional view of a sealing portion of a high pressure discharge lamp according to the present invention;

FIG. 1B is an enlarged cross-sectional view of a portion X of FIG. 1A

FIG. 1C is an enlarged view of part of the grooves and a partially enlarged view of a portion Y thereof;

DESCRIPTION

The present inventors identified the causes of damages to the sealing portion as a result of wholeheartedly examination about this phenomenon, as set forth below.

Figure 4A:
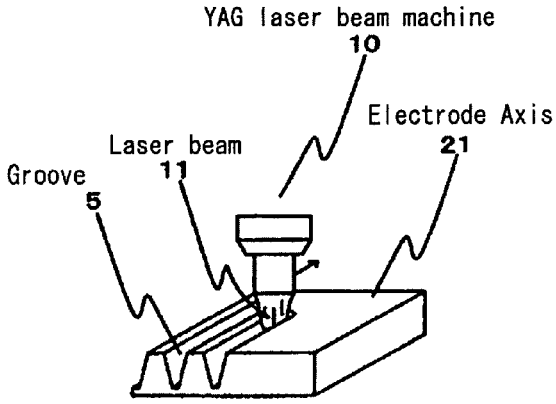
FIG. 4A Prior Art
FIG. 4A shows an explanatory diagram showing a conventional method using a laser beam for forming grooves.
Figure 4B:
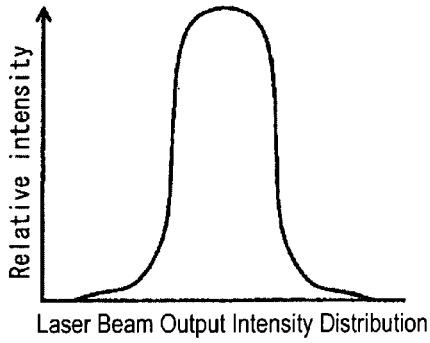
FIG. 4B Prior Art
FIG. 4B shows a normal output distribution of a laser beam.
Figure 4C:
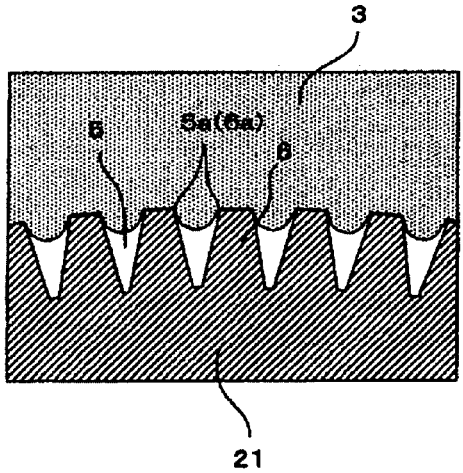
FIG. 4C Prior Art
FIGS. 4C and 4D show explanatory diagrams of grooves and a sealing portion of the prior art.

Since in the processing by the laser beam shown in FIGS. 4A, 4B and 4C, the energy of a beam is focused, wherein an output distribution of the laser beam in a cross section view thereof is generally shown in FIG. 4B. When the grooves 5 are formed on the electrode axis 21, in a manner as shown in FIG. 4A, by a laser beam with an output distribution, as shown in FIG. 4C, shoulder portions 5*a*, which are located above the groove 5, or corner portions having an acute angle are formed at a top portion 6*a* of each of convex portions 6 that form the grooves 5.

Figure 4D:
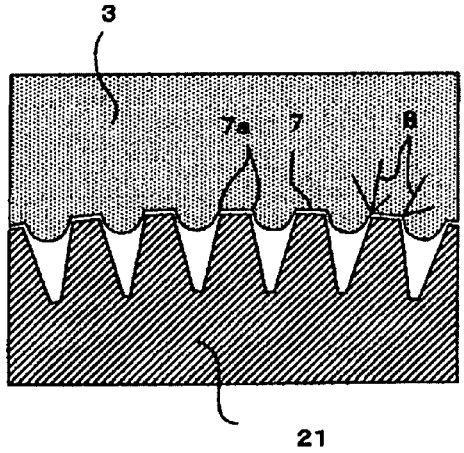
FIG. 4D Prior Art

When there are the shoulder portions 5*a* with the grooves 5 (the top portions 6*a* of the convex portion 6), which are the corner portions with an acute angle, as shown in FIG. 4C, glass of the sealing portion 3 is narrowed down toward the acute shoulder portions 5*a* of the groove 5 in a sealing process. When the sealing portion 3 and the electrode axis 21 are cooled down after the sealing process, as shown in FIG. 4D, the sealing portion 3 and the electrode axis 21 are separately provided so that small gaps are formed therebetween. However, in the cooling process, bottom corner portions 7*a* of each groove 7 that form in the glass of the sealing portion 3 are formed so as to have an acute angle. And as shown in FIG. 4D, cracks 8 are formed in the glass of the sealing portion 3 due to wrinkles engraved in the corner portions 7*a* having an acute angle. Due to expansion of the glass at time of lamp lighting, stress is concentrated on the corner portions 7*a* and the cracks 8, thereby causing breakage since the cracks 8 serve as starting points.

In order to solve the above-mentioned problem, shoulder portions in the high pressure discharge lamp according to the present invention located above the grooves should have a curved surface shape, so that while bottom corner portions of the grooves in a sealing portion glass side are formed to have a curved surface shape, the generation of cracks in the sealing portion is suppressed, and the stress concentration can be avoided at time of glass expansion.

According to the present invention, since the shoulder portions, which are located above two or more grooves formed on the electrode axis, have the shape of a curved surface, the stress concentration in the bottom corner portions of the grooves formed in the sealing portion glass side is avoided, so that there are effects that no crack is generated in these portions and breakage of the sealing portions does not occur.

FIG. 1A is a cross sectional view of a high pressure discharge lamp sealing portion according to the present invention. FIG. 1B is an enlarged cross-sectional view of a portion X of FIG. 1A. FIG. 1C is an enlarged view of part of the grooves and a partially enlarged view of a portion Y. In FIG. 1A, the two or more grooves 5 are formed in an electrode axis 21 in a sealing structure of the high pressure discharge lamp according to the present invention. A sealing portion 3 (silica glass) is heated at time of a sealing process, so that the sealing portion 3 is fused with the electrode axis 21. However, since the glass 3 and the electrode axis 21 are brought into contact with only convex portions 6, which are forms the grooves 5, the contact surface areas between them is small, so that the glass 3 and the electrode axis 21 are separated from each other in a cooling process, whereby some gaps are formed therebetween. Even if there is a difference in the amount of expansion and contraction due to the difference of coefficient of thermal expansion at time of lamp lighting and at time of light-out of the lamp, it is possible to prevent breakage. As shown in FIG. 1B, as to the shape of the grooves 5 according to the present invention, a shoulder portion 5*a*, which is located there above, that is, a top portion 6*a* of the convex portion 6, which forms the grooves 5, has the shape of a curved surface. Therefore, since a bottom corner portion of a groove 7, which is formed in a glass side of the above mentioned sealing portion 3, also has a curved surface shape, generation of cracks in that portion does not occur.

When the diameter of the above mentioned electrode axis 21 is 0.3 mm-1 mm, and the curvature radius of the curved surface shape of the shoulder portion 5*a* of the groove 5, which is formed in the electrode axis 21, is set to 5 μm-50 μm, wrinkles are not created in the glass side, so that it is possible to prevent damage in the sealing portion 3. In addition, although the silica glass of the sealing portion 3, which is brought into contact with the electrode axis 21 at time of a sealing process, becomes approximately 1,800° C., the viscosity of the silica glass at this time is approximately 6 log η (poise), so that it is in a very hard state, which is the hardness at the same degree as that of tar pitch at approximately 20° C. In this state, in case where the shoulder portion 5*a* of the groove 5 of the electrode axis 21 with a pointed tip at the same temperature as the silica glass of the sealing portion 3 is pressed thereon, the tip is pierced therein, and stops when entering the glass in the middle of a valley portion. For this reason, in case of the curvature radius of the curved surface of the shoulder part 5*a* is less than 5 μm, wrinkles are created in the sealing portion, thereby causing damages in the sealing portion. In contrast, when the curvature radius of the curved surface of shoulder portion 5*a* exceeds 50 μm, the contact surface area of the shoulder portion of the groove and the sealing portion increases, so that both are brought in close contact with each other. Thus, they are not separated from each other at time of cooling and breakage in the sealing portion occurs with lighting.

In addition, the diameter of the electrode axis 21 according to the present invention can be obtained by calculating an average diameter that is obtained by measuring twice or more times an outer surface on which the grooves 5 are provided, that is, by measuring outer diameters of the convex portions 6 by, for example, a micrometer. Moreover, the diameter of the electrode axis 21 can be obtained from an average that is obtained by measuring diameters in a cross section of the electrode axis 21, which is enlarged by a laser microscope. Moreover, the curvature radius of an upper shoulder portion 5*a* of the groove 5 can be measured by enlarging a cross section by a laser microscope.

In case where the grooves 5 are formed by laser irradiation, which is described below, the outer surface of the groove 5 can be roughed, as shown in FIG. 1C. The surface roughness Ra of the outer surface of the groove 5 (center line average roughness) is 0.05 μm-1 μm. Although the outer surface of the groove 5 and the sealing portion 3 are brought into contact with each other due to a difference in thermal expansion at time of lamp lighting, when the outer surface of the groove 5 has a rough surface, it is possible to suppress the close contact between the groove and the sealing portion 3 making it possible to prevent breakage that occurs due to the close contact of the sealing portion 3.

The above mentioned groove 5 of the electrode axis 21 can be formed by laser irradiation. A formation method thereof by the laser irradiation is explained referring to FIGS. 2A, 2B, 2C and 2D. The electrode axis 21 is formed with tungsten beforehand, and a laser processing machine 10 is prepared. As show in FIG. 2A, the laser beam (processing) machine 10 is configured so as to have a YAG laser, wherein a pulse beam 11, which is outputted from the laser, passes through an aspheric surface lens (not shown). A cross sectional output distribution of the beam 11 is shown in FIG. 2B. As mentioned above, although the normal output distribution of the beam 11 is shown in FIG. 4B, when it passes through the aspheric surface lens, it is possible to make an output 11*b* small in an outer circumference edge of the beam, compared with an output 11*a* in the central axis of the beam 11.

Figure 2A:
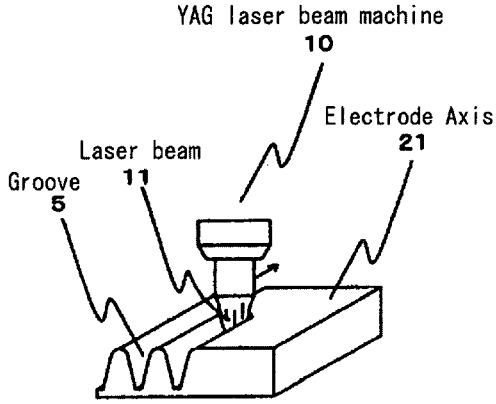
FIGS. 2A, 2B, 2C and 2D are explanatory diagrams incase of forming electrode grooves according to the present invention.
Figure 2B:
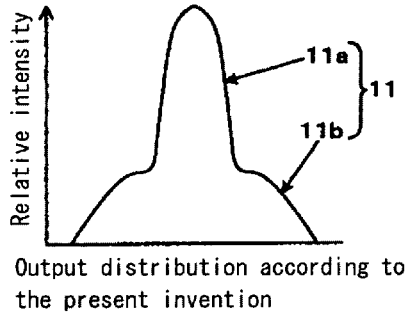

The pulse beam 11, which has such output distribution, is emitted toward the electrode axis 21, and the laser is moved along the electrode axis 21 (refer to FIG. 2A). When it reaches an end portion thereof to be processed, irradiation of the laser beam is stopped, and the electrode axis 21 is rotated by only a length of a groove pitch around the center point thereof, and while the pulse beam returns, the pulse beam 11 engraves a groove which is adjacent to the already formed groove. By repeating this step, as shown in FIG. 1A, two or more grooves 5, which extend in the longitudinal axis direction of the electrode 21, can be formed on the outer circumference of the electrode axis 21.

Figure 2C:
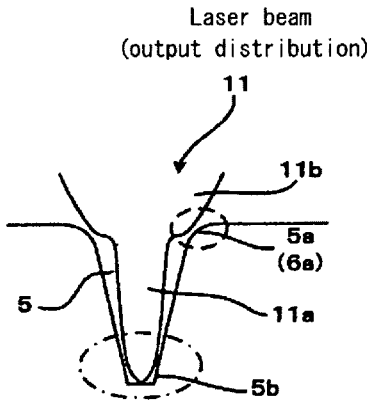
Figure 2D:
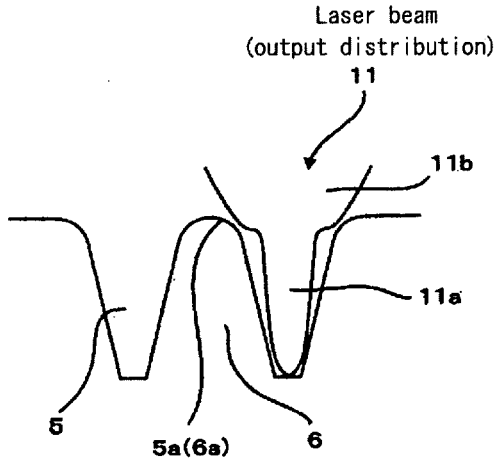
Figure 3A:
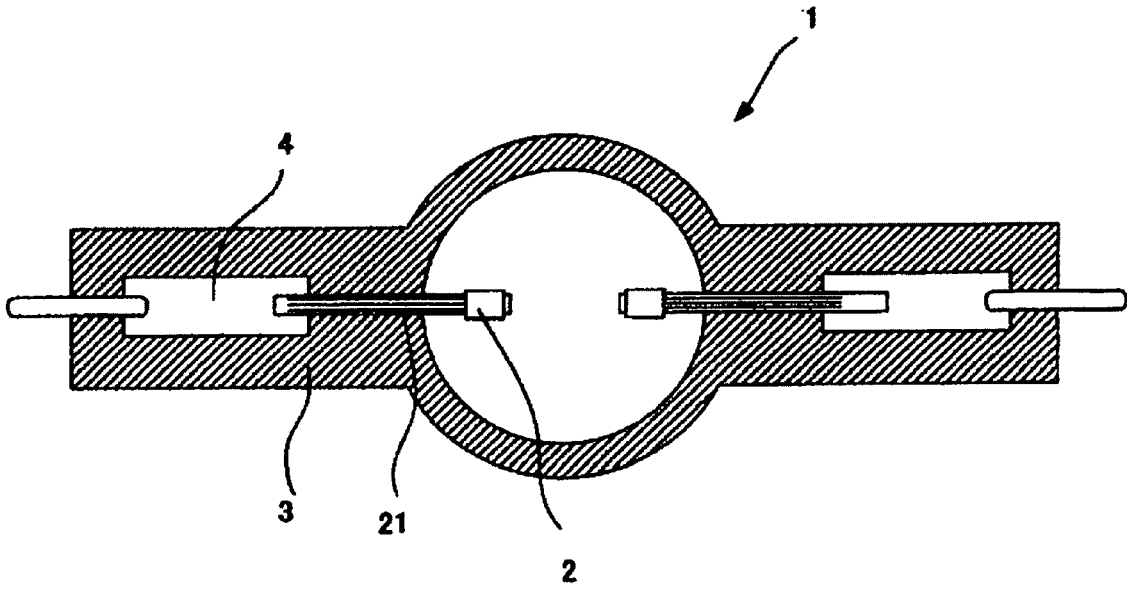
FIG. 3A Prior Art
FIG. 3A is a schematic diagram of the structure of a lamp according to the above-mentioned example of the prior art.
Figure 3B:
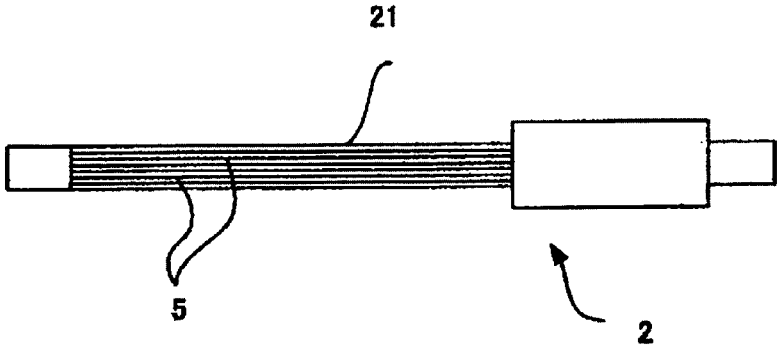
FIG. 3B Prior Art
FIG. 3B is an enlarged view of an electrode.

When the beam 11 having the output distribution shown in FIG. 2B is emitted on the electrode axis 21, since the central axis of the beam has a steep output 11*a* as show in FIG. 2C, the valley portion 5*b* of the groove 5 is formed deeply. On the other hand, the output 11*b* in the outer circumference edge of the beam is smaller than the output 11*a* at the central axis, and has the output distribution having a gradual slope in which the output thereof becomes smaller as closer to the outer circumference edge. Therefore, the output 11*b* of the beam with which it is irradiated becomes smaller as closer to the shoulder portion 5*a* of the groove 5, that is, as closer to the top portion 6*a* of the convex portion 6 that forms the groove 5, so that the upper shoulder portion 5*a* of the groove 5 is melted due to the gradual slope output distribution of the beam, thereby becoming a curved surface having a gradual slope. Furthermore, when the shoulder portion of an adjoining groove is melted with the beam, as shown in FIG. 2D, the top portion 6*a* of the convex portion 6 that forms the groove 5 is formed in the shape of a curved surface. Thus, the grooves, each of which has the shoulder portion in the shape of a curved surface according to the present invention, are formed by a beam whose beam distribution is made so as to be that shown in, for example, FIG. 2B, by an aspheric surface lens etc.

In addition, the condition at the time of laser irradiation is described bellow. The wavelength of the YAG laser is 1.06 μm. The power of the YAG laser is 1.85 kW. The diameter of the beam is 20 μm. A beam moving speed is 100 mm/s. The central-axis distance of the beam at the time of forming an adjoining groove is 25 μm.

When the grooves 5 are formed on the electrode axis 21 on the above condition, the curvature radius of the upper shoulder portions 5*a* of the grooves 5 is set to 15 μm, and the surface roughness is set to 0.05 μm-1 μm. In addition, although under the above condition, the top portion 6*a* of the convex portion 6 which forms the grooves 5, is not irradiated with the beam 11, the top portion receives the heat due to the beam irradiation. Part of the top portion evaporates due to this heat so that surface roughness is formed thereon. It is considered that although the valley portion 5*b* of the groove 5 is melted by irradiation of the beam 11, and during a cooling process after the beam passes that portion, evaporated material (tungsten) of the electrode axis 21 adheres thereon, forming the surface roughness. In addition, the curvature radius of the upper shoulder portion 5*a* of the groove 5 can be adjusted to 5 μm-50 μm by adjusting the output and scanning speed of the laser beam 11.

As mentioned above, in the high pressure discharge lamp according to the present invention, shoulder portions that are located above two or more grooves formed on the electrode axis of the electrode in the axial direction, have a curved surface shape, so that when the glass of the sealing portion is cooled down at time of the sealing process, bottom corner portions of the groove formed in a glass side does not become acute in shape, but rather curved in a surface shape, so that generation of the cracks in that portion is suppressed. Moreover, even if the sealing portion glass expands and contracts at time of lighting and light-out of the lamp, there is no stress concentration at that portion. Thus, the breakage effects of the sealing portion do not occur.

The preceding description has been presented only to illustrate and describe exemplary embodiments of the present high pressure discharge lamp. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope.

What is claimed is:

1. A high pressure discharge lamp comprising:

a pair of electrodes that face each other in an electric discharge container, each electrode having a cylindrical shape defining an outer cylindrical surface extending radially from and along a cylindrical axis, wherein an electrode axis of each electrode is buried in a sealing portion, wherein each electrode axis is joined to a metallic foil, wherein two or more grooves are formed in the outer cylindrical surface along an axis direction on a portion of the electrode axis, which contacts a silica glass sealing portion, wherein each groove extends in the longitudinal axis direction of the electrode, wherein an upper shoulder portion of each groove is formed in a shape of a curved surface, wherein a diameter of the electrode axis is 0.3 mm to 1 mm, wherein a curvature radius of the curved surface upper shoulder portion is 5 μm-50 μm, wherein the two or more grooves are spaced-apart from one another as viewed in radial cross-section such that an incremental section of the outer cylindrical surface spans juxtaposed ones of the two or more grooves and interconnects respective ones of the upper shoulder portions and wherein a plurality of the incremental sections of the outer cylindrical surface as viewed in radial cross-section extend radially equidistantly from the cylindrical axis.

2. The high pressure discharge lamp according to claim 1, wherein a surface roughness at an upper shoulder portion of an outer surface of the grooves is 0.05 μm-1 μm.

3. A method for forming grooves in electrodes of a high pressure discharge lamp according to claim 1, the method comprising the step of:

irradiating each one of the electrodes with a laser beam to form the grooves thereinto.

* * * * *